United States Patent [19]

Kitazume et al.

[11] Patent Number: 5,033,891

[45] Date of Patent: Jul. 23, 1991

[54] PRINTING MACHINE

[75] Inventors: Koichiro Kitazume; Tsuneo Shiozaki, both of Tokyo, Japan

[73] Assignee: Daiwa Seiko, Inc., Tokyo, Japan

[21] Appl. No.: 388,018

[22] Filed: Aug. 1, 1989

[30] Foreign Application Priority Data

Aug. 17, 1988 [JP] Japan ..... 63-205063
Aug. 17, 1988 [JP] Japan ..... 63-205064

[51] Int. Cl.[5] ..... B41J 11/58

[52] U.S. Cl. ..... 400/624; 271/162; 271/164; 400/629; 400/647

[58] Field of Search ..... 400/624, 625, 629, 634, 400/646, 647; 271/162, 164

[56] References Cited

U.S. PATENT DOCUMENTS

| | | | |
|---|---|---|---|
| 4,475,731 | 9/1984 | Wood | 271/164 |
| 4,498,794 | 2/1985 | Waibel | 400/629 |
| 4,565,360 | 1/1986 | Runzi | 400/629 |
| 4,616,819 | 10/1986 | Makio et al. | 271/164 |
| 4,635,923 | 1/1987 | Steinhilber | 271/162 |
| 4,812,065 | 3/1989 | Shimogawara et al. | 400/624 |

FOREIGN PATENT DOCUMENTS

| | | | |
|---|---|---|---|
| 0163263 | 12/1985 | European Pat. Off. | 400/624 |
| 0185673 | 10/1984 | Japan | 400/629 |
| 0202872 | 9/1986 | Japan | 400/624 |
| 2177069 | 1/1987 | United Kingdom | 400/624 |

*Primary Examiner*—Eugene H. Eickholt
*Attorney, Agent, or Firm*—Kalish & Gilster

[57] ABSTRACT

The present invention relates to a rotation transmission mechanism for transmitting the rotation of a drive gear on a printer body side to a driven gear as a rotation power source on a paper feeder side. The present invention includes a gear shaft of the driven gear freely movably disposed on the paper feeder side so that the driven gear engages with the drive gear on the printer body side. In the present invention, when the paper feeder is placed on the printer body, the gear shaft of the driven gear of the paper feeder moves downward from a position it holds when the paper feeder is removed from the printer body, and the driven gear is engaged with the drive gear of the printer body.

9 Claims, 13 Drawing Sheets

PRINTING MACHINE

BACKGROUND OF THE INVENTION

1. Field of the Invention

The present invention relates to a printer, and more specifically to a rotation transmission mechanism to transmit the rotation of a drive gear on the printer body side to a driven gear as a rotation power source on a paper feeder side.

2. Description of the Prior Art

There are known printers used as output devices for computer systems, office automation and otherwise, for example it is well known that there is Japanese Utility Model Application Laid-open Print No. 62-163331.

A conventional printer will be described below with reference to FIG. 21. In the drawing, 201 is a printer which consists of a printer body 202 and a paper feeder 203, wherein the paper feeder 203 can be placed in position on the printer body 203 and also detached therefrom. This structure will be described in detail below.

Reference numeral 204 is a platen of the printer body 202. Both ends of its shaft 204*a* are rotatably attached to a frame 205 of the printer body 202. This shaft 204*a* has side plates 206*a*, 206*b* of a frame body 206 of the above paper feeder 203 detachably attached thereto, and also has a small DC motor 208 connected via a gear train 207.

On the other hand, the feeder 203 has a paper feeding shaft 209 rotatably and horizontally mounted between the right and left side plates 206*a*, 206*b* which constitute the frame 206. The paper feeding shaft 209 is provided with a paper feeding rubber roller 210.

Reference numeral 211 is a paper discharge roller which is mounted on a roller shaft 212 which is rotatably set horizontally between the right and left side plates 206*a*, 206*b*.

Rotation of the printer body 202 is transmitted to a rotation transmission shaft 216 from a drive gear 213 attached to the shaft 204*a* via driven gears 214 and 215 on the paper feeder 203 side. Rotation of the rotation transmission shaft 216 drives the paper feeding shaft 209 and the roller shaft 212 by gear transmission. Specifically, engaging the drive gear 213 with the driven gear 214 transmits the rotation of the printer body 202 to the paper feeder 203.

The platen shaft 204*a* is detachably attached with the side plates 206*a*, 206*b* of the frame body 206 of the above paper feeder 203. Thus, when the paper feeder 203 is placed in position on the printer 202, the paper feeder 203 is accurately positioned with regard to the printer body 202 so as to engage the drive gear 213 with the driven gear 214.

Such a printer has a structure that the right and left side plates 206*a*, 206*b* are directly carried by the platen shaft 204*a* so as to engage the drive gear 213 with the driven gear 214, so that the engagement of the drive gear 213 with the driven gear 214 based on the right and left side plates 206*a*, 206*b* is done precisely and easily.

Because the weight of the paper feeder 203 is supported by the platen shaft 204 via the both side plates 206*a*, 206*b*, however, it is required to make the platen shaft 204*a* and the frame 205 be tough. Also, the weight of the paper feeder 203 may degrade accurate operation of the printer 201 or induce resonance of the printer 202 and the paper feeder 203, resulting in deterioration of the appearance of letters typed on printer 201.

Therefore, the drive gear 213 and the driven gear 214 are not designed to be engaged with reference to both side plates 206*a*, 206*b*, but as shown in FIG. 22, a side cover 217 is produced to have a structure to be placed on a printer body cover 218 which forms a periphery of the top opening of the printer body 202, so that the platen shaft 204*a* does not have to directly support the weight of the paper feeder 203, thus remedying the above drawbacks. In this case, it becomes necessary to secure a precise engagement of the drive gear 213 with the driven gear 214 as shown in FIG. 21, but such an accurate engagement of those gears are not realized, resulting in causing an uncertain transmission of the rotation from one gear to another and breakage of gear teeth, too.

The reasons include that as shown in FIGS. 21 and 22, a reference face for placing the paper feeder 203 on the printer body 202 consists of the printer body cover 218 of the printer body 202 and the side cover 217 of the paper feeder 203. Thus it is necessary to secure precision of the drive gear 213 with respect to the printer body cover 218 and that of the driven gear 214 to the side cover 217, but because the printer body cover 218 and the side cover 217 are originally produced to provide dust prevention and noise reduction, their produced sizes are not necessarily uniform. Therefore, it is difficult to secure a precise engagement of the drive gear 213 with the driven gear 214.

And in FIGS. 21 and 22, the drive gear 213 and the driven gear 214 are required to be engaged precisely but, when the paper feeder 203 is placed on the printer body 202, the engaging operation of the driven gear 214 and the drive gear 213 and the mating operation to place in position the frame body 206 of the paper feeder 203 onto the printer body 202 are determined by their order with the engaging operation first and the mating operation next, thus placing the paper feeder 203 in position on the printer body 202 to be engaged with each other and resulting in determining the relative relation between the gears. In this case, the paper feeder 202 is not stably placed in a proper position on the printer body 202 but in loose contact with it. Therefore, the frame body 206 of the paper feeder 203 and the printer body 202 are not mated stably with each other. Thus, there are drawbacks in that transmission of the rotation between the gears is uncertain and the gear teeth may be broken.

SUMMARY OF THE INVENTION

An object of the present invention is that in a printer to transmit the rotation of a drive gear on the printer body side to a driven gear on the paper feeder side under a state that the side cover of the paper feeder is placed on the printer body cover, the printer is provided with an accurate transmission of driving power by accurately and easily engaging the drive gear on the printer body side and the driven gear on the paper feeder side.

Another object of the present invention is to provide a printer wherein even when the relative sizes of the driven gear to the drive gear is not secured, the shaft of the driven gear of the paper feeder is freely movably attached to the paper feeder so that the driven gear is accurately engaged with or disengaged from the drive gear of the printer body.

A further object of the present invention is to provide a printer in which the drive gear on the printer body side and the driven gear on the paper feeder side are readily engaged and in which both gears can be prevented from wearing.

And still another object of the present invention is to provide a printer wherein the paper feeder can be placed on the printer body cover without any space therebetween and that inclusion of dust into the top opening and escape of noise through the top opening can be prevented.

As even further object of the present invention is to provide a printer wherein transmission of the rotation of a drive gear on the printer body side to a driven gear on the paper feeder side under a state that the side cover of the paper feeder is placed on the printer body cover, the printer can have its paper feeder stably placed in position on the printer body when the paper feeder is stably placed in position on the printer body.

An additional object of the present invention is, for the engaging operation of the driven gear and the driving gear and the mating operation to determine the position of the paper feeder on the printer body, to provide a printer capable of stably determining a position of the paper feeder on the printer body with a tight contact with it by the order of the mating operation to determine a position and the mating operation when the paper feeder is placed in position on the printer body.

In the present invention, when the paper feeder is placed on the printer body, the shaft of the driven gear of the paper feeder moves downward from the position in a state when the paper feeder is removed from the printer body and the driven gear engages with the drive gear of the printer body.

In the present invention, the driven gear of the paper feeder is disengaged and held apart from the drive gear of the printer body by a driven gear holding mechanism until the paper feeder is placed on the printer body.

Then, after the paper feeder is placed in position on the printer body, a driven gear release mechanism works to release the holding condition keeping the driven gear and the drive gear as separated.

After releasing the holding condition keeping both gears separated by the driven gear releasing mechanism, the driven gear engaging mechanism works to accurately engage the driven gear with the drive gear.

DESCRIPTION OF THE PREFERRED EMBODIMENT OF THE INVENTION

Figure 1:
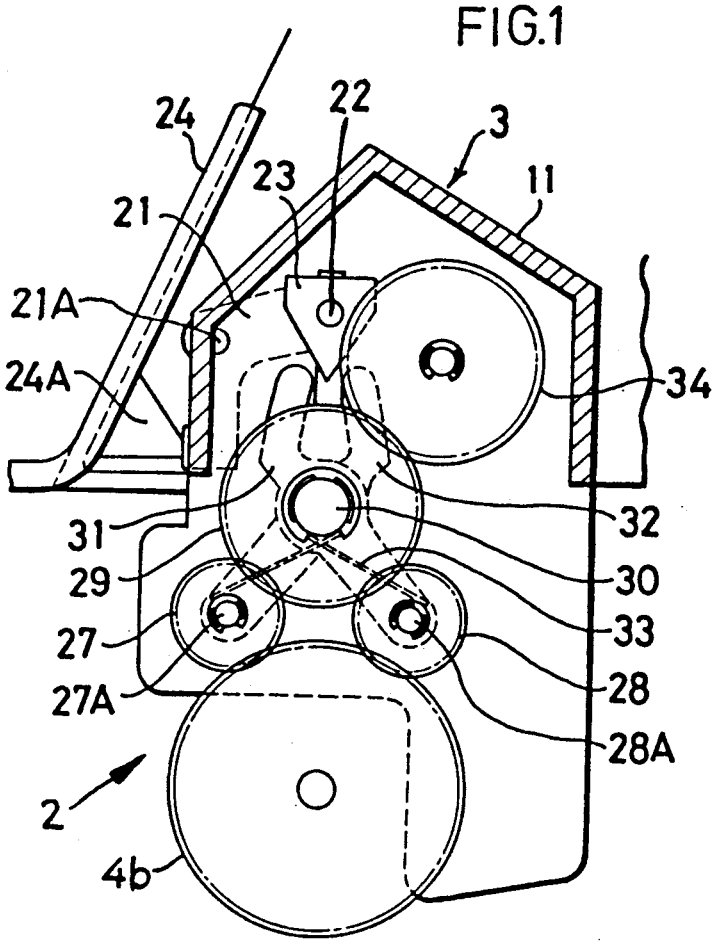
FIG. 1 is a sectional vertical side view of the main part of the printer according to the first preferred embodiment of the present invention.

The embodiments of the present invention will be described below with reference to the drawings.

FIGS. 1 to FIGS. 10 show the structure of the printer according to the first embodiment of the present invention. First, the whole structure such as placing the printer in position will be described with reference to FIG. 3 to FIG. 6. Then, the main part of the invention will be described with reference to FIG. 1 and FIG. 2.

In FIG. 3 to FIG. 6, 1 is a printer according to this embodiment, which consists of a printer body 2 and a paper feeder 3 freely detachable from the printer body 2.

The printer body 2 includes an inner mechanism such as a platen 4 and other mechanisms, both ends of a platen shaft **4*a* of the platen 4 being rotatably attached to frames 5, 5. The platen shaft 4*a* is provided with a drive gear 4*b*, and the outside of the frames 5, 5 is protected by a printer body cover 6 and its top is provided with a top opening 7**.

Periphery 8 of the printer body cover 6 is formed into the shape of a gate in cross section, forming an edge of the top opening 7 of the printer body 2. Flanges 8A formed on the inner surface of the both sides of the periphery 8 have mating holes 9, 9 drilled respectively, and the right inner surface of the periphery 8 is formed with a flange 8B.

For a paper feeder 3, both frame side plates 11, 11 carrying a roller shaft **10*a* of a paper feed roller 10 have their outside covered with a side cover 12 respectively. The bottom ends of the both side plates 11, 11 are provided with mating projections 13 respectively. The right side plate 11 is provided with a hook 14**.

The main point of the invention will be described below with reference to FIG. 1 and FIG. 2. In the drawings, the frame side plate 11 of the paper feeder 3 has an L-shaped cam lever 21 axially mounted with a shaft 21A at the center, and one end of the cam lever 21 is fitted with a cam shaft 2 to which a triangle cam 23 with pointed corners is freely fitted.

The cam shaft 22 has one end of a coil spring 25 connected and the other end of the coil spring 25 connected to a projection 26 disposed on the frame side plate 11. The cam shaft 22 is applied with a force pulling it downward. The other end of the cam lever 21 is designed to be pushed by a cam lever pushing piece 24A provided at the tip of the front cover 24 so that the cam lever 21 rotates about the shaft 21A against the coil spring 25

Reference numerals 27, 28 are a pair of driven gears engaged with both the drive gear 4*b* of the printer body 2, and 29, a second gear of the gear train and are disposed on the paper feeder 3 side. The above paired of driven gears 27, 28 are positioned to face each other edgewise across an imaginary line running vertically through the axis of the drive gear 4*b* of the printer body 2 (FIG. 1).

A supporting shaft 30 carrying the second gear 29 of the gear train is disposed on the frame side plate 11. This supporting shaft 30 carries a pair of supporting plates 31, 32 freely rotatably. These supporting plates 31, 32 cross each other to form the shape of X. The supporting plates 31, 32 are provided at the bottom ends thereof with gear shafts 27*a*, 28A which carry driven gears 27, 28 respectively. Therefore, the driven gears 27, 28 are designed to swing about the supporting shaft 30 through the supporting plates 31, 32.

The supporting shaft 30 carrying the second gear 29 of the gear train has a torsion spring 33 which pushes the gear shafts 27A, 28A downward (in the direction mutually approaching). This pushing force of the torsion spring 33 is smaller than the tensile force of the coil spring 25 which lowers the cam 23 downward.

In the drawings, 34 is a third gear of the gear train, engaged with the second gear 29 of the gear train.

The operation of this embodiment will be described below.

Figure 7:
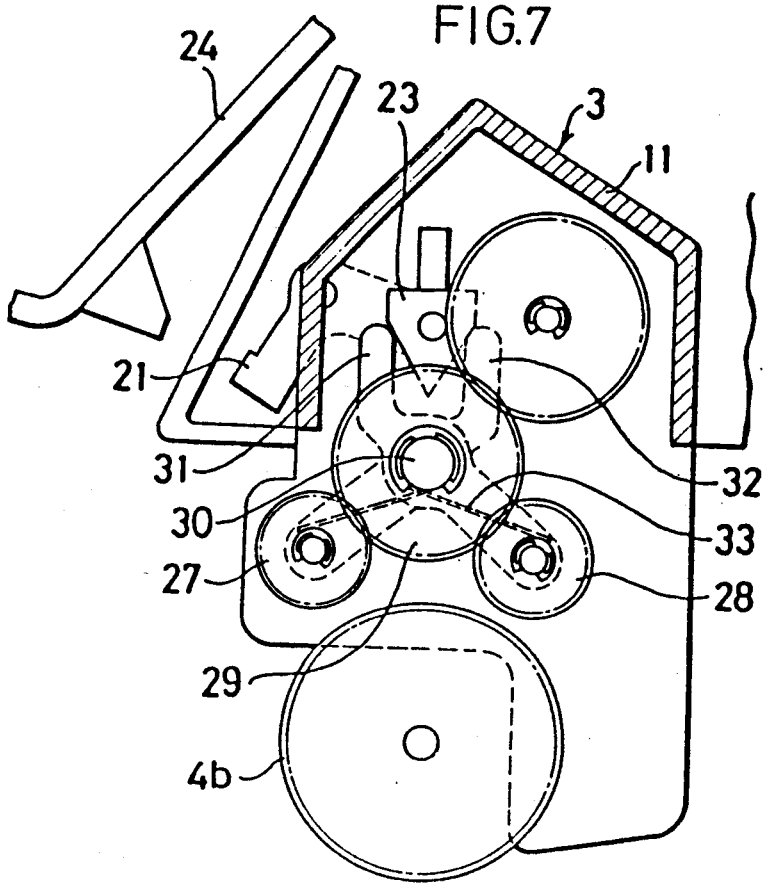
FIG. 7 is an operation explanatory view of the same printer.
Figure 8:
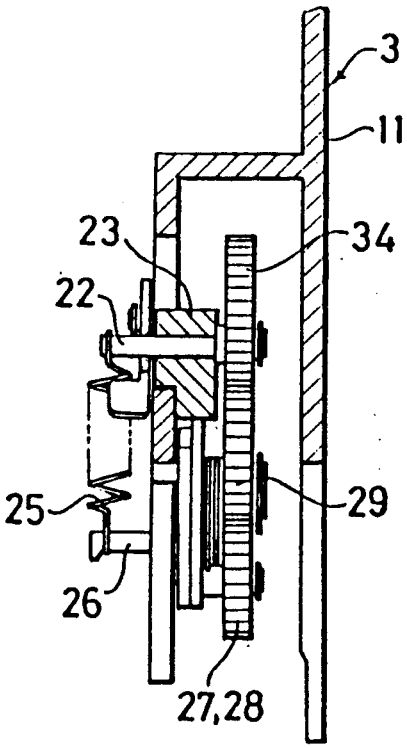
FIG. 8 is a sectional front view of the main part of the printer according to the same embodiment.
Figure 9:
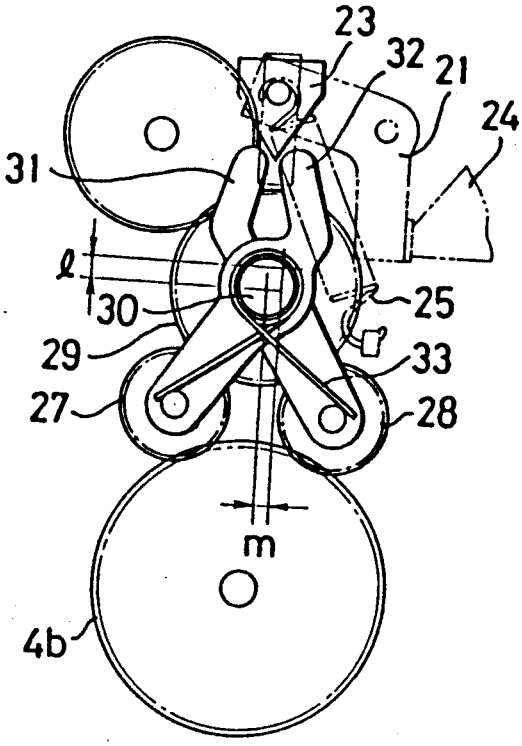
FIG. 9 is an operation explanatory view showing the engaged state of the drive gear and the driven gears.

To place the paper feeder 3 on the printer body 2, the front cover 24 is opened and the driven gears 27, 28 are pulled up and held there, then the side cover 12 of the paper feeder 3 is placed in position on the printer body cover 6 of the printer body 2. More specifically, as shown in FIG. 3 to FIG. 6, the paper feeder 3 is placed on the periphery 8 of the printer body cover 6 via the side cover 12 so that it is supported by the printer body cover 6. A mating projection 13 of the frame side plate 11 of the paper feeder 3 is mated with a mating hole 9 of the printer body cover 6, so that the paper feeder 3 is placed horizontally with respect to the printer body 2. The state of the gears in this case is shown in FIG. 7 and FIG. 8. In this state, the front cover 44 is raised up, so that the cam lever 21 is not pressed by the front cover 24. The pressing force of the torsion spring 33 is smaller than the tensile force of the coil spring 25 which pulls down the cam 23, so that the cam 23 is pushed downward by the coil spring 25. This downward force pushes open the top of the supporting plates 31, 32, making the driven gears 27, 28 rotate in opposite directions with the support shaft 30 centered therebetween to be suspended afloat and not engaged with the drive gear 4*b*.

Figure 2:
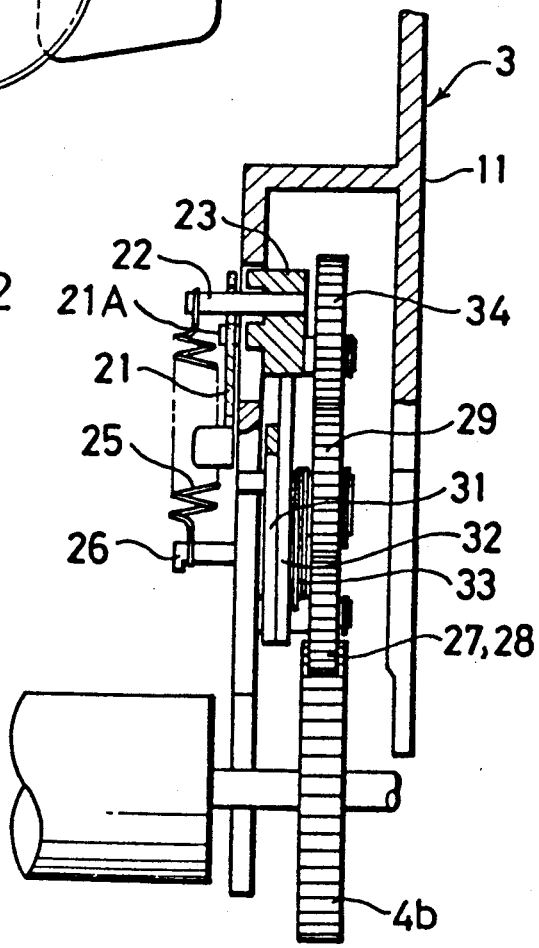
FIG. 2 is a partial sectional front view of the main part of the same printer.
Figure 3:
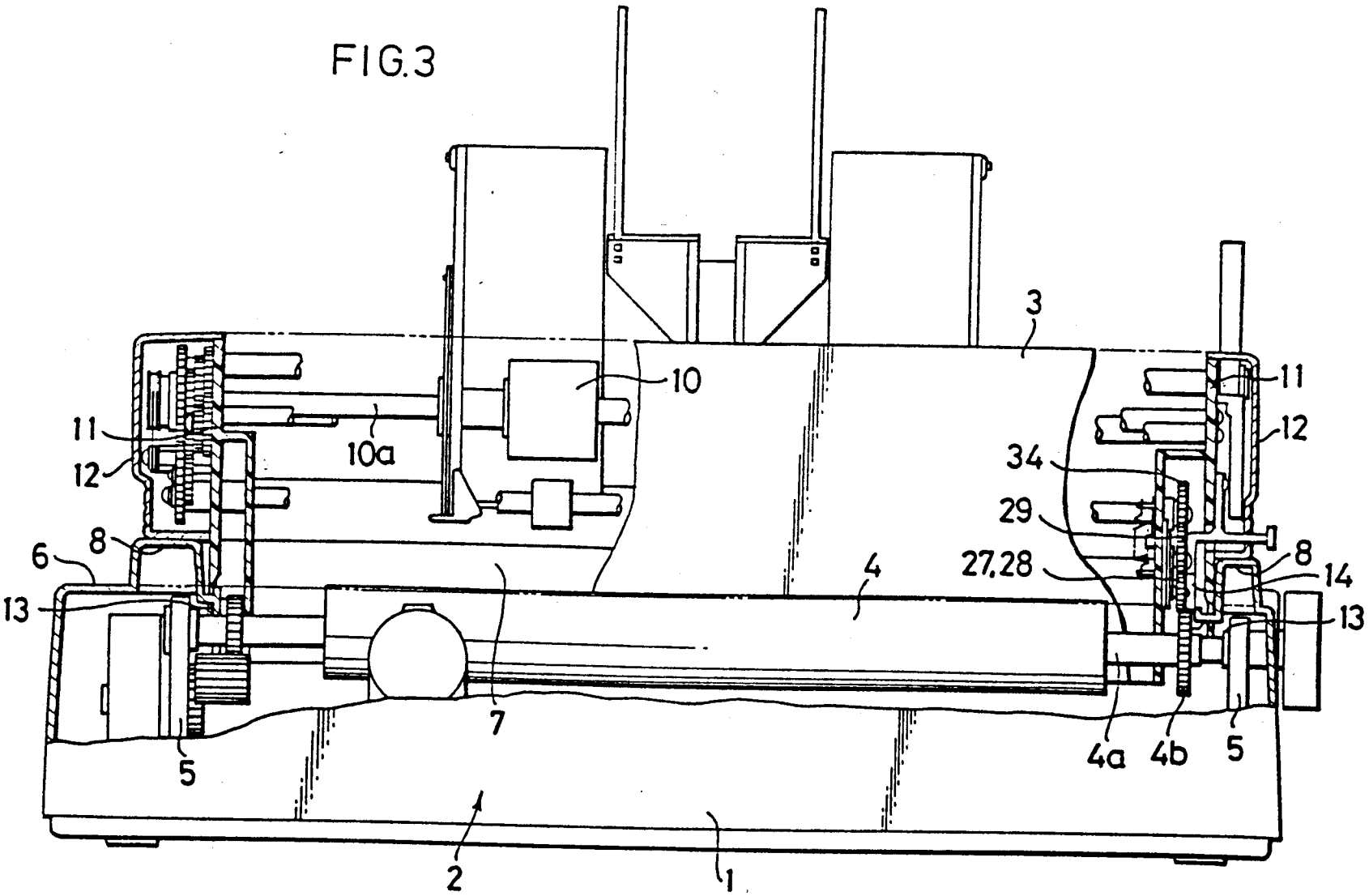
FIG. 3 is a partially sectional front view illustrating the whole structure of the same printer.
Figure 4:
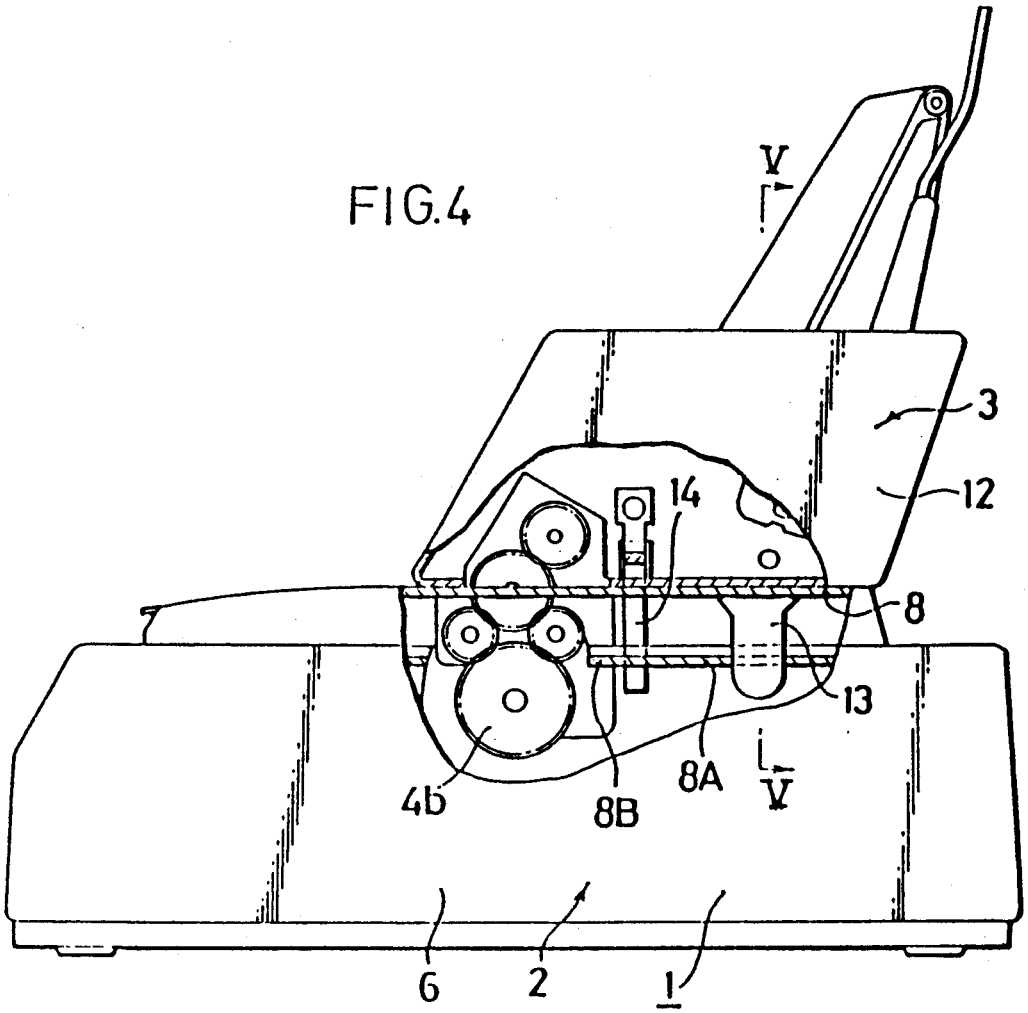
FIG. 4 is partially sectional side view illustrating the whole structure of the same printer.
Figure 5:
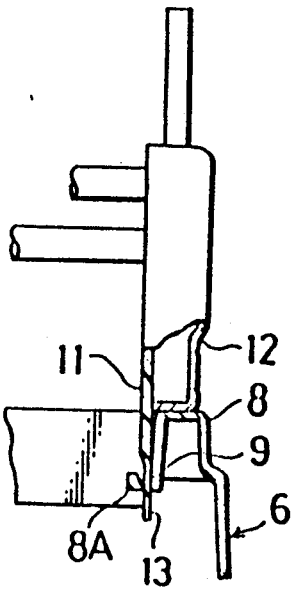
FIG. 5 is a sectional view taken on line V—V of FIG. 4 illustrating the position determining relation between the printer body and the paper feeder.
Figure 6:
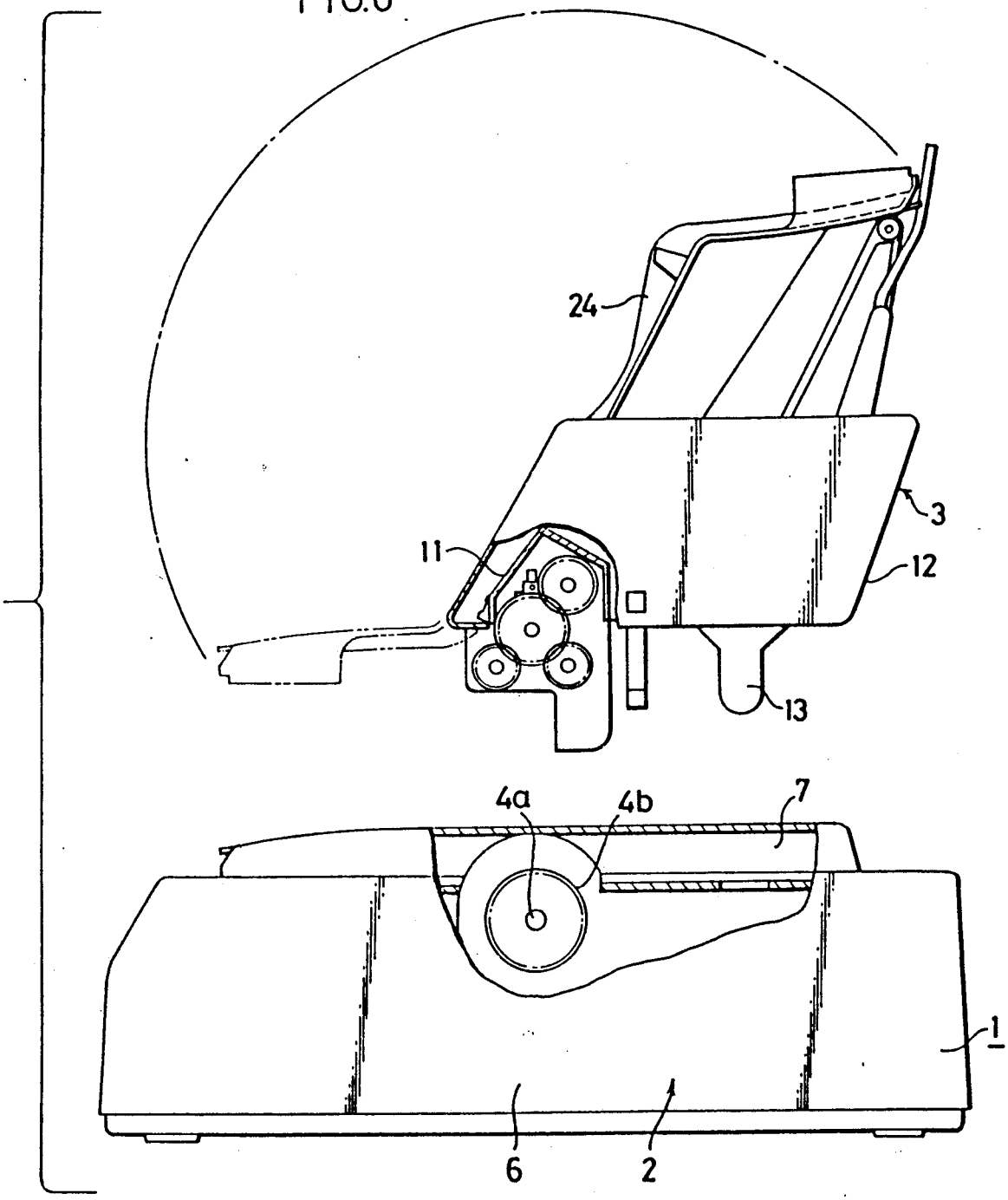
FIG. 6 is a partially sectional side view of the printer disassembled according to the first embodiment of the present invention.

As shown in FIG. 1, FIG. 2 and FIG. 6 (two dots and line), the front cover 24 is lowered to push the cam lever 21 by it, and the cam 23 is forced to be pushed upward against the force of the coil spring 25.

Accordingly, the top of the supporting plates 31, 32 can move freely, and the torsion spring 33 is forced to move downward such that the driven gears 27, 28 which are supported by the bottom of the supporting plates 31, 32 axially supported by the supporting shaft 30 move in mutually approaching direction. Thus, the driven gears 27, 28 engage with the drive gear 4*b* of the printer body 2.

The printer of this embodiment consists of a driven gear holding mechanism in which the driven gears 27, 28 of the paper feeder are pulled upward by the coil spring 25 so as to be separated and kept away from the drive gear 4*b* of the printer body 2, a driven gear release mechanism in which after placing the paper feeder 3 in position on the printer body 2 the cam lever pushing piece 24A of the front cover 24 pushes the contact face 21*b* of the cam lever 21 so as to push the cam 23 upward against the coil spring 25 so as to release the separated condition of the both gears, and a driven gear engaging mechanism in which after releasing the separated-gear holding condition by the driven gear releasing mechanism, the torsion spring 30 forces the driven gears 27, 28 supported at the bottom of the supporting plates 31, 32 to move downward to engage the driven gears 27, 28 with the drive gear 4*b*.

Figure 10:
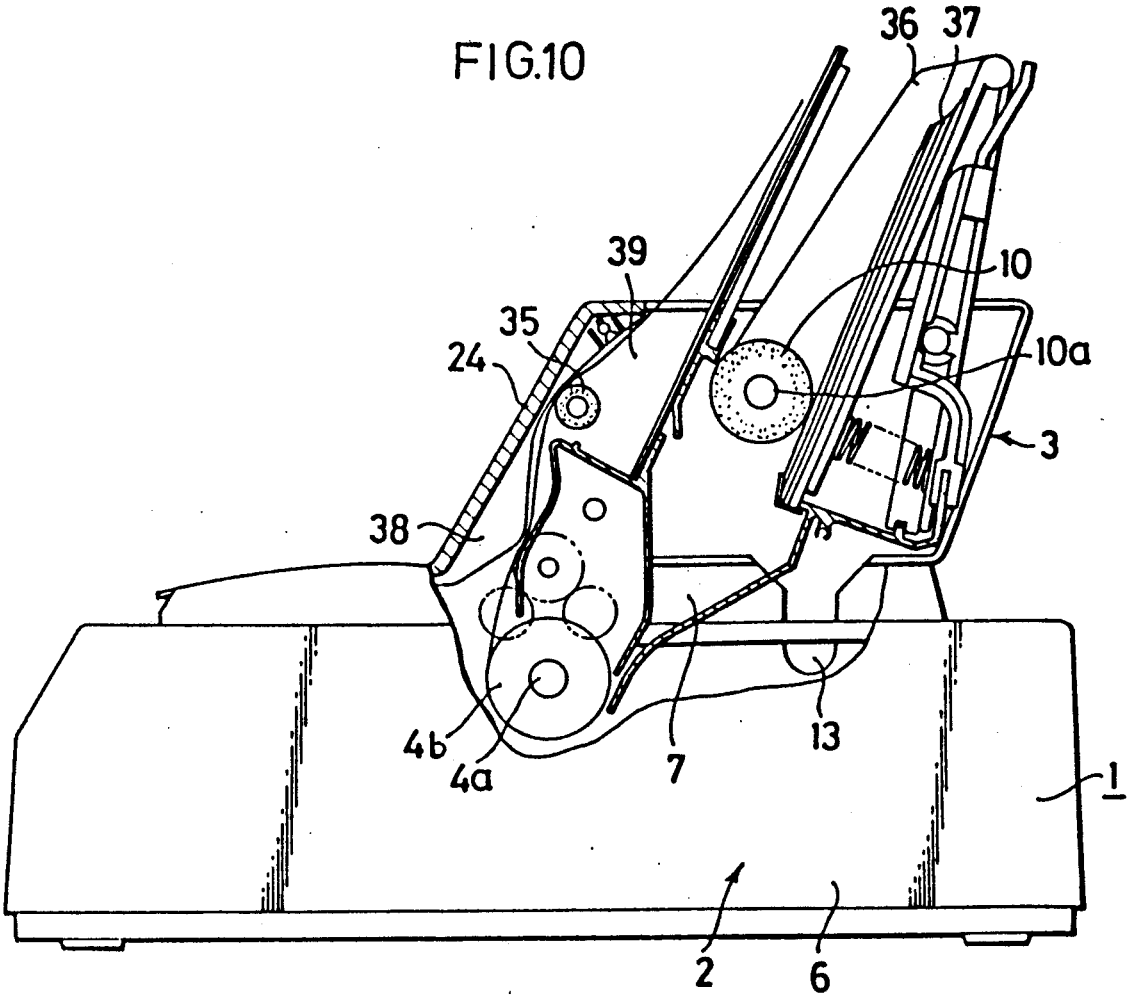
FIG. 10 is a partially sectional side view of the printer assembled according to the same embodiment.

In the paper feeder 3 as shown in FIG. 10, the paper feeding roller 10 attached to the roller shaft 10*a* which is supported by the both frame side plates 11, 11 is driven by the drive gear 4*b*, the driven gears 27, 28 on the paper feeder side engaged therewith, the second and third gears 29 and 34 (FIG. 1) of the gear train, and another gear train (not shown) engaged therewith and feeds paper sheets one by one to the platen 4 at the printing section in the printer body from the top to the bottom of sheets stacked on a stacker 36. Then the printed sheets are piled on a discharge paper stacker 39 by means of a discharge roller 35 and a guide rib 38 formed on the front cover 24.

The effects of this embodiment will be described below.

First, because of dimensional errors and misaligned assembling due to injection molding of the printer body cover 6 and the side cover 12 of the paper feeder 3, the position of the supporting shaft 30 on the paper feeder 3 side is not secured with respect to the position of the axis of the drive gear 4*b* on the printer body 2 side. (For example, in FIG. 9, in case of relative dimensional errors in vertical and cross directions (1) and (m)). Thus there may be a situation in which the relative dimensions of the driven gears 27, 28 with respect to the drive gear 4*b* are not attained.

In this case, since the axes of the driven gears 27, 28 of the paper feeder 3 are freely movably disposed on the paper feeder 3 so that the driven gears 27, 28 are detachably engaged with the drive gear 4*b* of the printer body 2, the driven gears 27, 28 of the paper feeder 3 accurately engage in a state following the drive gear 4*b* of the printer body 2 under the condition that it is shifted by an appropriate distance from the proper position.

Therefore, it becomes easy to engage the drive gear 4*b* on the printer body 2 side and the driven gears 27, 28 on the paper feeder 3 side. Moreover, the gears can engage accurately to prevent wear of the gear teeth.

Besides, since the paper feeder 3 is accurately placed on the printer body 2, the paper feeder 3 can be closely placed on the printer body cover 6, so that entering of dust into the top opening 7 or escape of noise from the same opening 7 can be prevented.

Second, as described above, when the paper feeder 3 is placed in position on the printer body 2, if the driven gears 27, 28 on the paper feeder 3 side are not placed in position securely with respect to the position of the drive gear 4*b* on the printer body 2 side, the gear shafts 27A, 28A of the driven gears 27, 28 swing about the supporting axis 30 of the second gear of the gear train which is fixed on the frame side plate 11 of the paper feeder 3, and the driven gears 27, 28 move an appropriate distance from their proper position almost along the nominal direction with the drive gear 4*b* to engage with the drive gear 4*b* of the printer body 2.

Therefore, it becomes easy to engage the drive gear 4*b* on the printer body 2 side and the driven gears 27, 28 on the paper feeder 3 side, making it possible to prevent wear of the gear teeth because of the accurate engagement of the both gears.

Third, since the above pair of driven gears 27, 28 are disposed to face to each other edgewise, with a vertical line running through the axis of the drive gear 4*b* of the printer body 2 as a reference, either of the pair of driven gears 27, 28 which engages with the drive gear 4*b* receives force in the direction it engages at the time of sudden reverse rotation of the drive gear 4*b* to always provide a secure engagement of the gears. Thus, the direction of rotation and speed of the drive gear 4*b* of the printer body 2 can be correctly transmitted to the driven gears 27, 28 of the paper feeder 3.

Fourth, to determine the position of the paper feeder 3 by placing it on the printer body 2, for the engaging operation of the driven gears 27, 28 and the drive gear 4*b* and the mating operation for determining the position of the paper feeder 3 and the printer body 2, the mating operation for position determination and the engaging operation are done in this order, and the paper feeder 3 can be stably placed in position on the printer body 2 without being floated.

Figure 21:
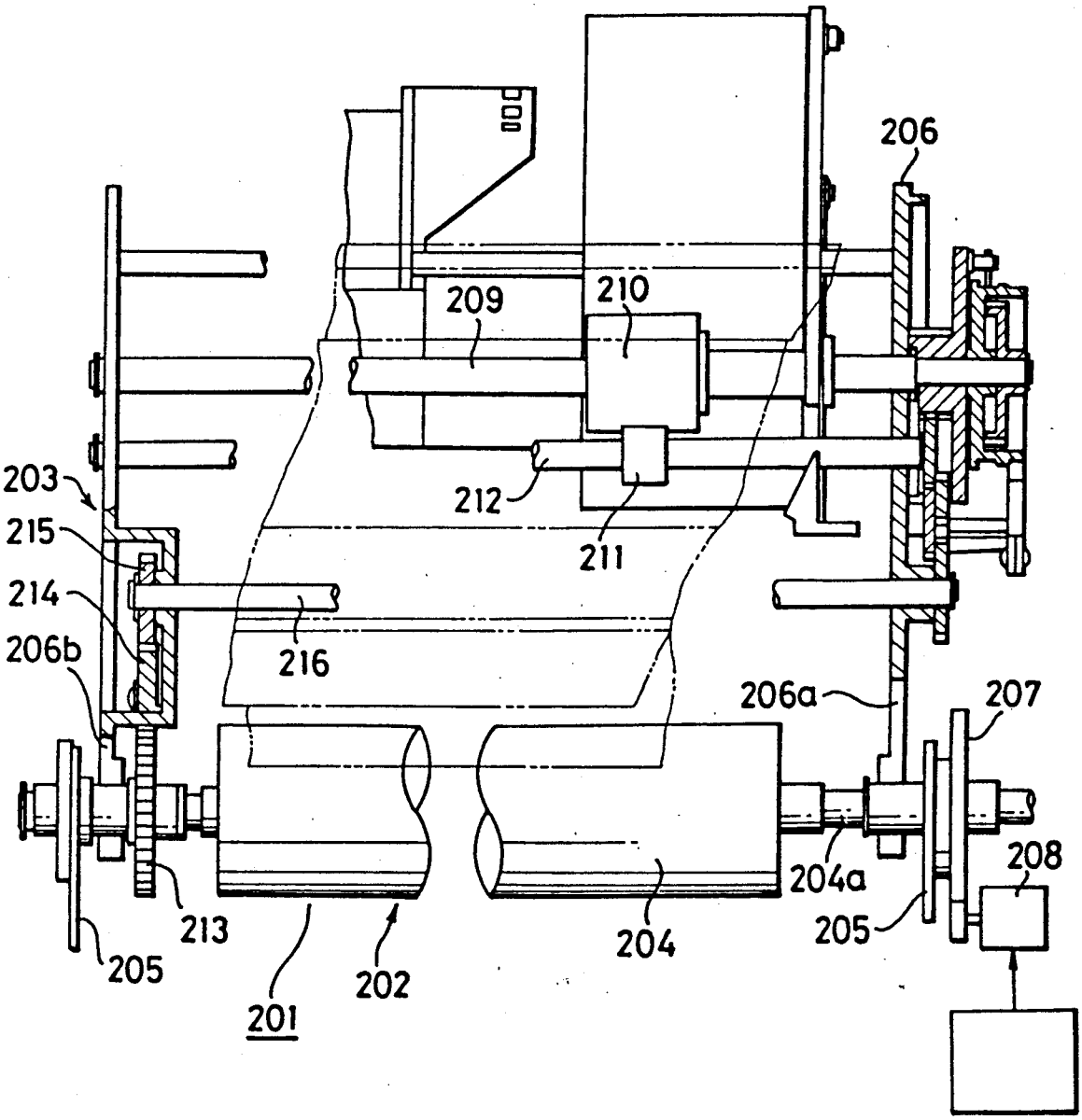
FIG.21 PRIOR ART
FIG. 21 is a sectional view of a conventional printer.
Figure 22:
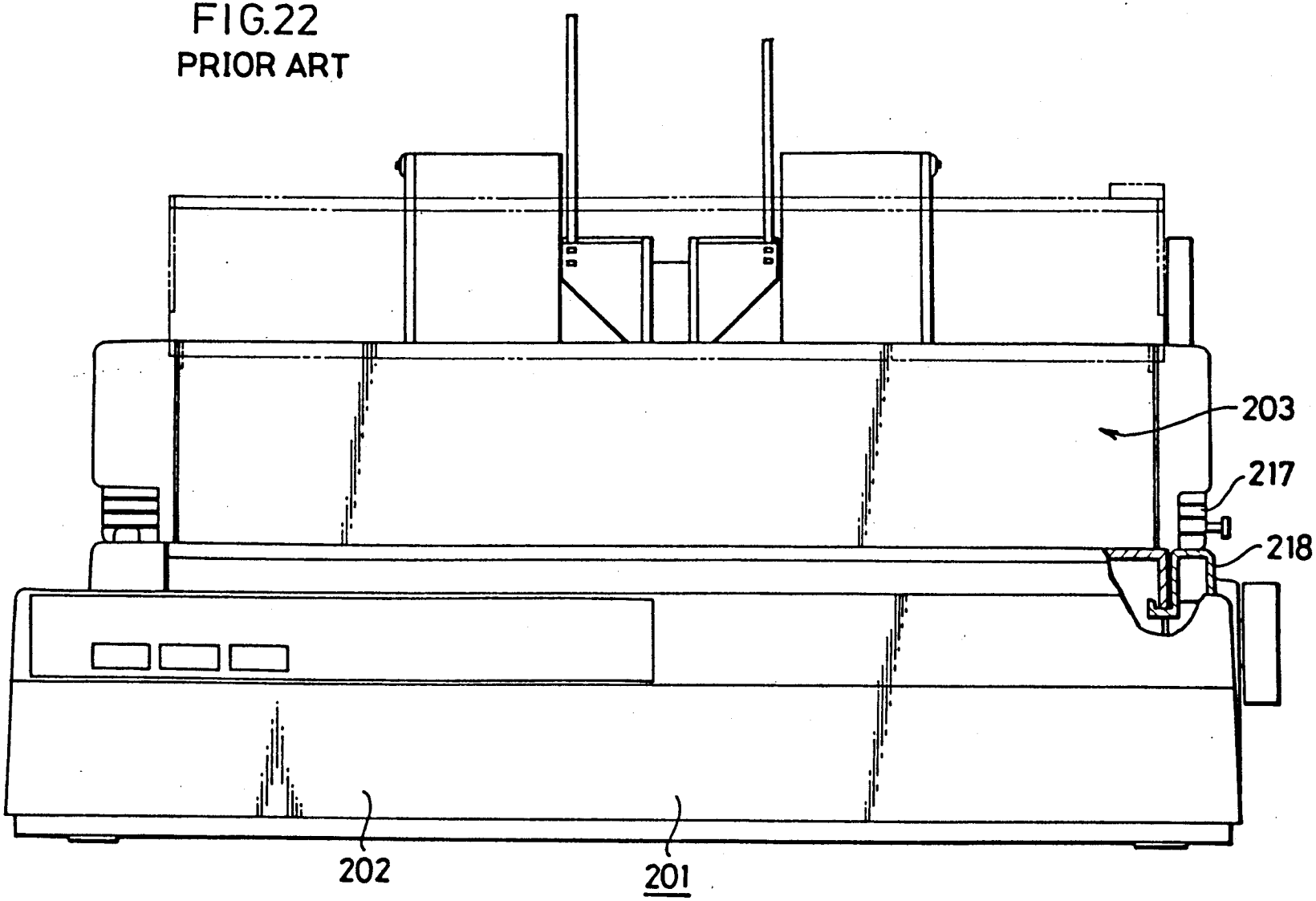
FIG.22 PRIOR ART
FIG. 22 is a partially sectional front view of a conventional printer.

Further, in addition to this embodiment wherein the paper feeder 3 is placed on the printer body case 6, in the case that frame side plates 206*a*, 206*b* are detachably provided with a platen shaft 104*a* as shown in FIG. 21, the above order of the mating operation for position determination and the engaging operation can be applied, so that the driven gears 27, 28 can be smoothly and accurately engaged with the drive gear 4*b* without wearing their gear teeth.

Figure 11:
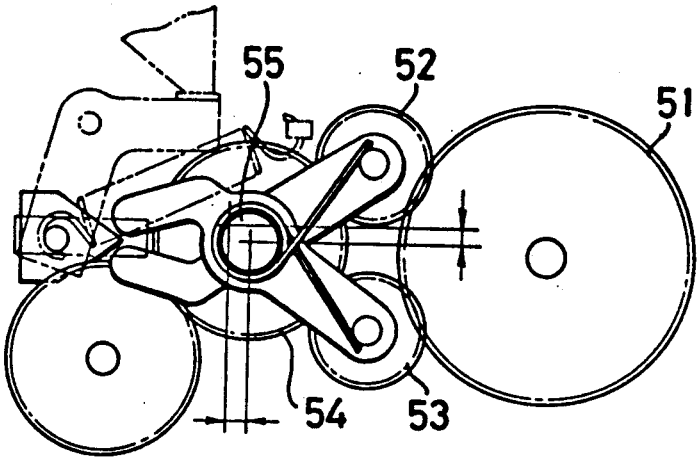
FIG. 11 is a partial explanatory view of the gears arranged illustrating modification of the embodiment.

In the above embodiment, the pair of driven gears 27, 28 are disposed to face to each other edgewise with a vertical line as a reference running through the axis of the drive gear 4*b* of the printer body 2. However, as shown in FIG. 11, driven gears 52, 53 and a second gear 54 of the gear train can be disposed horizontally with respect to a drive gear 51 of the printer body. More specifically, a supporting shaft 55 of the second gear 54 of the gear train engaged with the pair of driven gears 52, 53 is supported by the frame side plate of the paper feeder, and the above pair of driven gears 52, 53 are arranged to face to each other edgewise with respect to the horizontal line connecting the axis of the drive gear 5 and that of the second gear 54 of the gear train.

In the above modification, when the drive gear 51 makes a sudden reverse rotation, either of the pair of driven gears 52, 53 receives force in the direction it engages with the drive gear 51 to provide always a secure engagement of the gears, thus providing the same effects as above.

Figure 12:
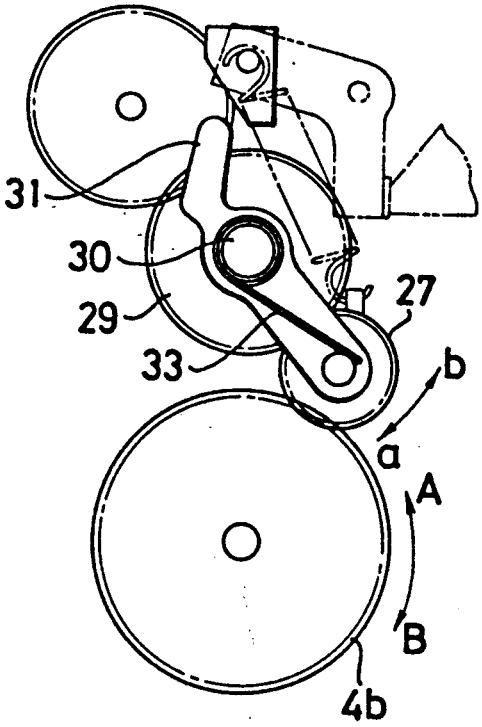
FIG. 12 is a side view of the main part of the printer according to the second embodiment of the present invention.

FIG. 12 shows a main part of the printer according to the second embodiment of the present invention.

In the second embodiment, except that only one driven gear 27 is provided as a driven gear the other structure is the same as in the first embodiment.

In this embodiment, when the drive gear 4*b* rotates in the direction A, the supporting plate 31 which is carried by the supporting shaft 30 supporting the second gear 29 of the gear train receives force in the direction (a) to securely transmit the rotation to the driven gear 27. But, it is possible that when the rotation of the drive gear 4*b* changes from the direction A to the direction B, the driven gear 27 is pushed upward in the direction (b), resulting in floating the driven gear 27 up. In this case, the floating-up can be prevented by increasing the pressure of the torsion spring 33.

In the second embodiment, the same effects as in the first embodiment can be attained.

Figure 13:
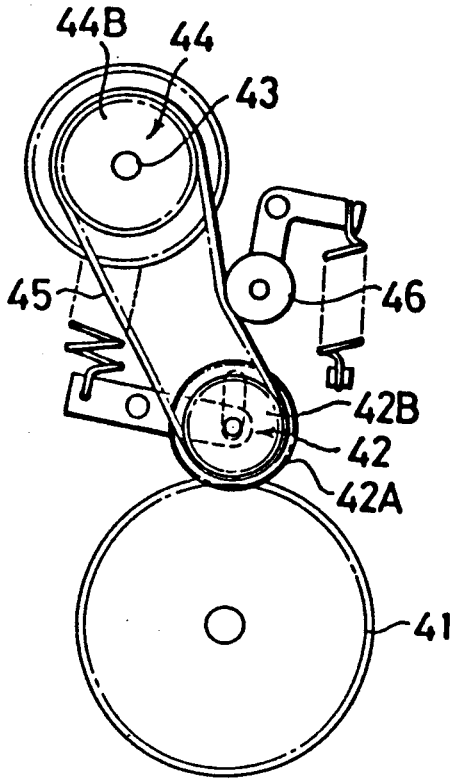
FIG. 13 is a side view of the main part of the printer according to the third embodiment of the present invention.

FIG. 13 shows a main part of the printer according to the third embodiment of the present invention.

As shown, a drive gear 41 on the printer body side is engaged with a gear 42A of a driven toothed pulley 42 on the paper feeder, and a belt 45 connects a pulley 42B of the driven toothed gear 42 and a pulley 44B of a toothed pulley 44 mounted to a roller shaft 43.

In this case, when the belt 45 becomes loose due to variation of the engaged position of the drive gear 41 and the gear 42A of the driven toothed pulley, it is tightened by adjusting the position of a tension pulley 46.

In the third embodiment, the same effects as in the first embodiment can be attained.

Figure 14:
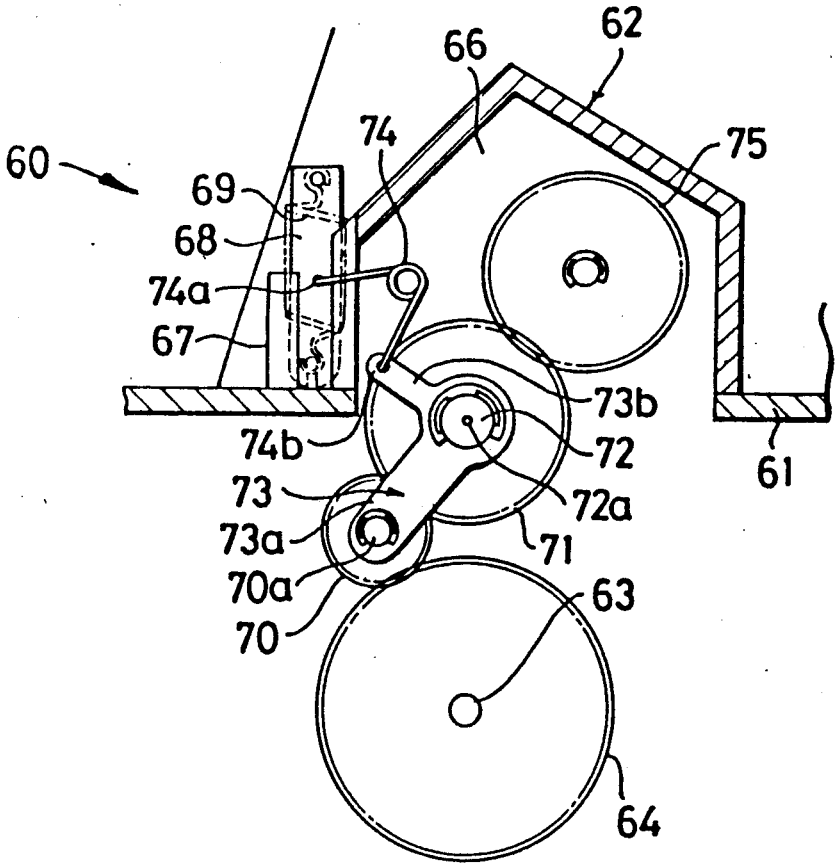
FIG. 14 is a side view of the main part of the printer according to the fourth embodiment of the present invention.
Figure 15:
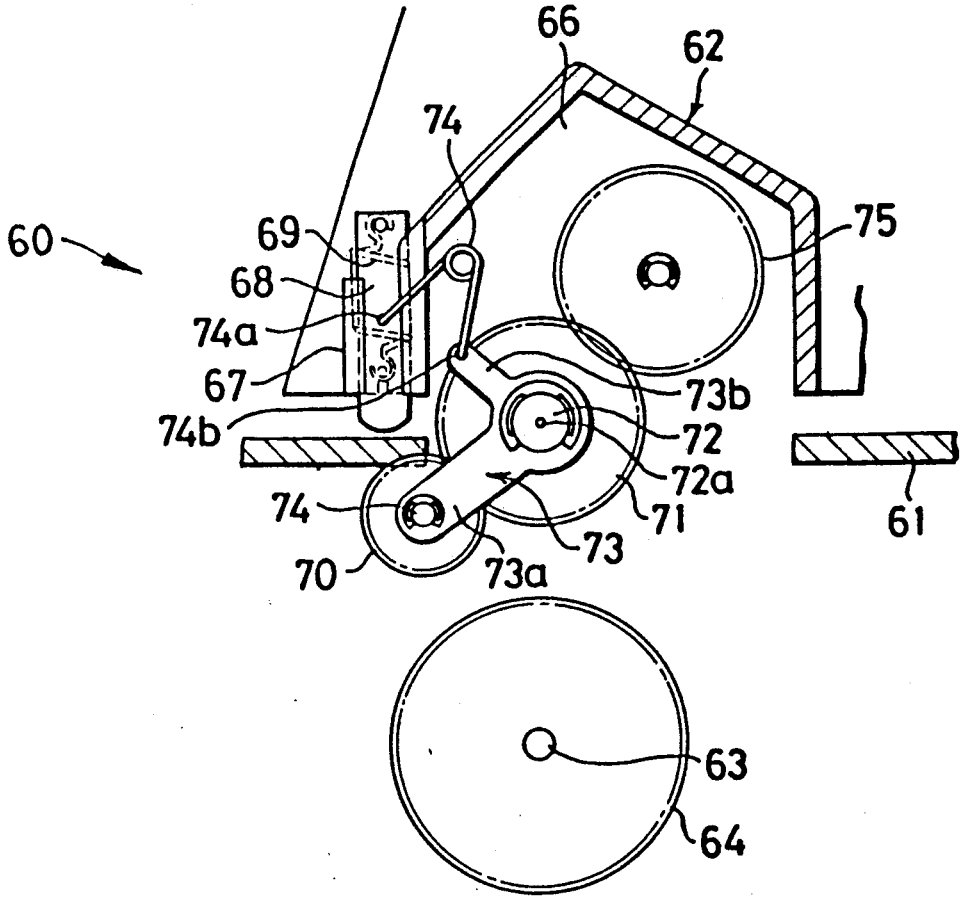
FIG. 15 is an operation explanatory view of the same printer.

FIG. 14 and FIG. 15 show the structure of the printer of the fourth embodiment of the present invention.

In the drawings, 60 is a printer according to this embodiment, which consists of a printer body 61 and a paper feeder 62 which can be detachably placed on the printer body 61.

The printer body 61 contains a platen (not shown) and other inner mechanisms, both ends of a platen shaft 63 of the platen being rotatably mounted axially to a frame (not shown). The platen shaft 63 is provided with a drive gear 64, and the frame exterior is protected by a printer body cover 65. For the paper feeder 62, the exterior of both frame side plates 66 which support a roller shaft (not shown) of a paper feeding roller of the paper feeder is provided with a side cover to cover with it.

The frame side plate 66 of the paper feeder 62 is provided with an operation rod guide groove 67, which has an operation rod 68 attached to be able to slide vertically. On the top end of the operation rod 68 is disposed a coil spring 69, whose other end is attached to the frame side plate 66. This coil spring 69 energizes the operation rod 68 downward to protrude from the bottom of the operation rod guide groove 67.

Reference numeral 70 is a driven gear as a rotation power source to engage with the drive gear 64 of the printer body 61, and 71 is a second gear of the gear train engaging with the driven gear 70; both are disposed on the paper feeder 62 side.

A supporting shaft 72 carrying the second gear 71 of the gear train is disposed on the frame side plate 66. This supporting shaft 72 supports freely rotatably an L-shaped supporting plate 73. A gear shaft 70*a* provided at the bottom end of the gear support 73*a* of the supporting plate 73 supports the driven gear 70. Thus, the driven gear 70 is designed to swing as engaged with the second gear of the gear train about the supporting shaft 72 via a supporting plate 73.

A torsion spring support 73b of the supporting plate 73 and the center of the operation rod 68 are connected via a torsion spring 74, which springs less than the coil spring 69. Adjusting the spring force of the torsion spring 74 prevents the driven gear 70 from floating up when the drive gear 64 makes reverse rotation (counterclockwise), thereby receiving the driving force accurately whenever the drive gear rotates normally or reversely. In the drawings, 75 is a third gear of the gear train engaging with the second gear 71 of the gear train.

Accordingly, the printer according to this embodiment consists of a driven gear holding mechanism in which the driven gear 70 of the paper feeder 62 is separated and kept away from the drive gear 64 of the printer body 61, a driven gear release mechanism in which after placing the paper feeder 62 in position on the printer body 61 both gears are released from being kept separated from each other, and a driven gear engaging mechanism in which after releasing the separated-gear holding condition by the driven gear releasing mechanism, the driven gear 70 is engaged with the drive gear 64.

Now, the operation of this embodiment will be described below.

FIG. 15 shows a state wherein the paper feeder 62 is not placed on the printer body 61.

In this case, if the coil spring 69 is not provided, the center point 72a of the supporting shaft 72 and the mounting parts 74a, 74b of the torsion spring 74 must be on a straight line. But, the attaching part 74a of the torsion spring 74 is pulled downward by the coil spring 69 and the torsion spring 74 rotates in the counterclockwise direction. To take balance with that moment, the supporting plate 73 receives a clockwise moment, and the supporting plate 73 rotates in the clockwise direction about the supporting shaft 72. Specifically, the driven gear holding mechanism works to keep a condition such that the driven gear 70 of the paper feeder 62 is separated and held at an appropriate interval from the drive gear 64 of the printer body 61 by means of a stopper (not shown).

Then, FIG. 14 shows a state such that the paper feeder 62 is placed in position on the printer body 61.

In this case, the operation rod 68 is pushed upward by the printer body 61 and the mounting part 74a of the torsion spring 74 moves upward against the coil spring 69. When the center point 13a of the supporting shaft 72 and the mounting parts 74a, 74b of the torsion spring are adjusted to align on a straight line immediately before tightly contacting the paper feeder 62 and the printer body 61 (the operation rod 68 is pushed upward to the highest position), since the mounting part 74a is positioned above the straight line of the mounting parts 74a, 74b and the center point 72a just before placing the paper feeder 62 on the printer body 61, the mounting part 74b is positioned below the line connecting the mounting part 74a and the center point 72a when the paper feeder 62 is placed on the printer body 61, and the mounting part 74b is pressed by the partial pressure (force in the direction at a right angle to the supporting plate 73) of the spring force of the torsion spring 74, and the supporting plate 73 rotates in the counterclockwise direction about the supporting shaft 72. That is, the driven gear release mechanism releases the separated condition of the both gears, and the driven gear engaging mechanism works to engage the driven gear 70 with the drive gear 64.

According to the above structure, when the paper feeder 62 is placed in position on the printer body 62, for the engaging operation of the driven gear 70 and the drive gear 64 and the mating operation for determining the position of the paper feeder 62 and the printer body 61, the mating operation for position determination and the engaging operation are done in this order, and the paper feeder 62 can be stably placed in position on the printer body 61 without being floated.

Thus, the rotation can be surely transmitted between the gears with less wear of the gear teeth.

Since the paper feeder 62 can be placed on the printer body cover 65 with a tight contact, inclusion of dust into the top opening (not shown) or escape of noise therethrough can be prevented.

Figure 16:
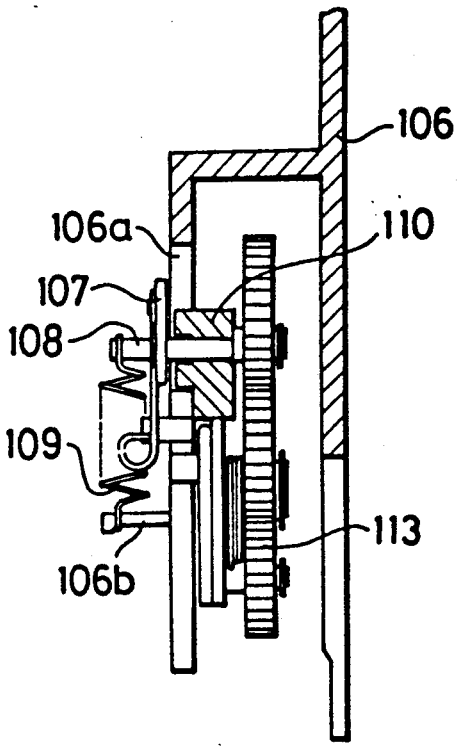
FIG. 16 is a sectional view illustrating modification of the driven gear release mechanism of the same printer.
Figure 17:
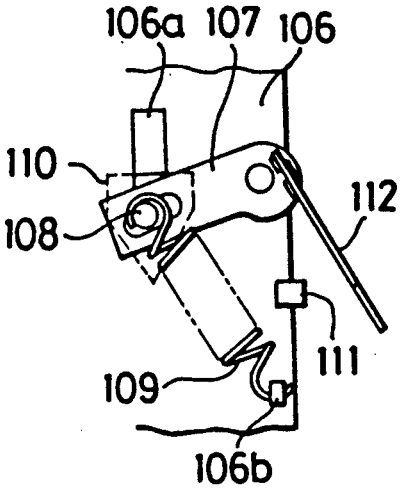
FIG. 17 and FIG. 18 are operation explanatory views of the same driven gear release mechanism.
Figure 18:
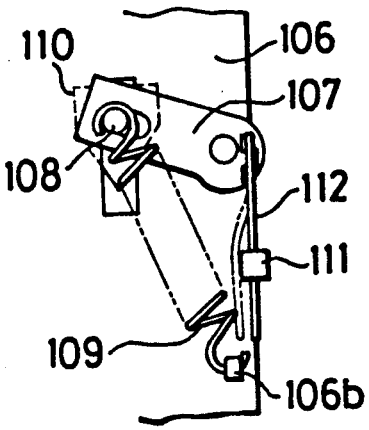

FIG. 16 to FIG. 18 show modification in the driven gear release mechanism of the printer in the first embodiment.

In the first embodiment, the driven gear release mechanism makes the cam lever pushing piece 24A of the front cover 24 push the contact face 21b of the cam lever 21 to push upward the cam 23 against the coil spring 25 so as to release the separated condition of the both gears. But the release of the driven gear of the printer is not limited to this mechanism. There may be employed the following.

In FIG. 16 and FIG. 17, to one end of a cam lever 107 disposed freely rotatably on a frame side plate 106 of a paper feeder (not shown) is connected one end of a coil spring 109 via a cam shaft 108 which vertically moves along a guide window 106a, and the other end of the coil spring 109 is connected to a projection 106b disposed on the frame side plate 106. The cam shaft 108 is forced to be pulled downward and the cam 110 disposed on the cam shaft 108 is pulled downward. Reference numeral 111 is a hook attached to the frame side plate 106, and 112 an elastic lever attached to the cam lever 107.

As shown in FIG. 18, the elastic lever 112 is stopped with the hook 111, then the cam lever 107 rotates clockwise to push cam 110 upward along the guide window 106a against the tensile force of the coil spring 109. Thus, the driven gear 113 lowers to engage with the drive gear (not shown) of the printer.

Figure 19:
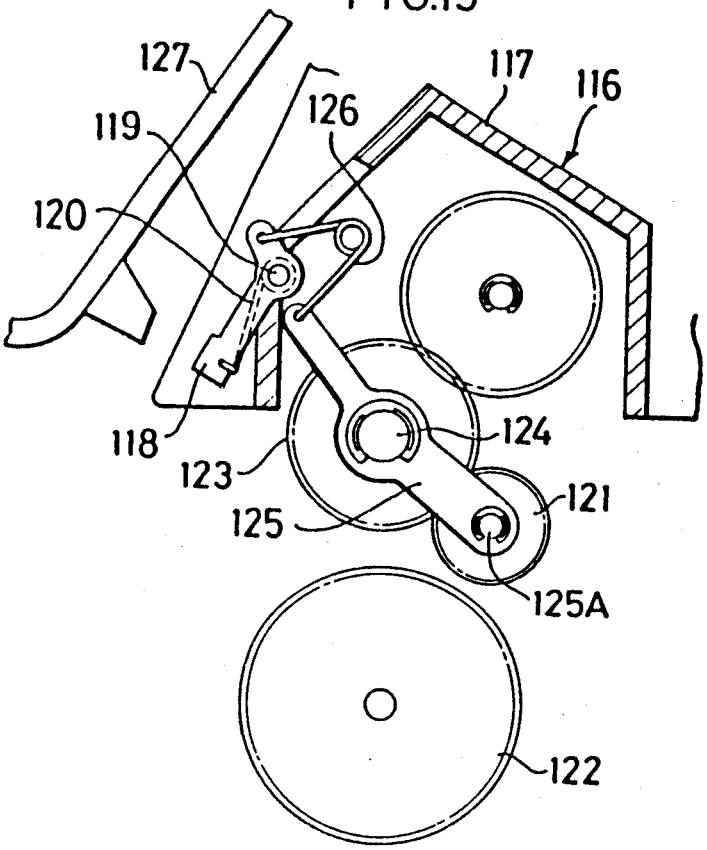
FIG. 19 and 20 are partially sectional side views of the printer according to the fifth embodiment of the present invention.
Figure 20:
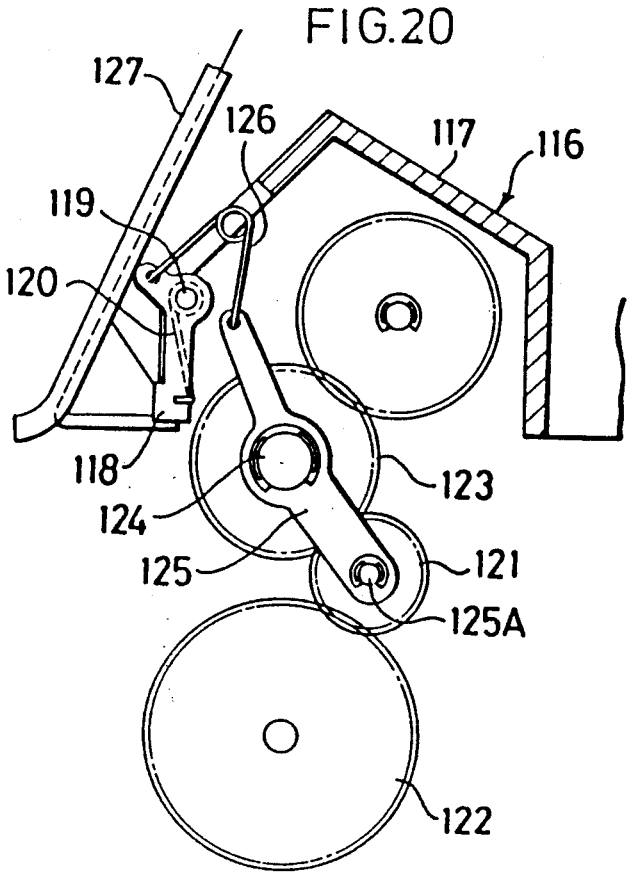

FIG. 19 and FIG. 20 show a partial sectional side view of the printer according to the fifth embodiment of this invention.

In the drawings, a cam lever 118 is axially supported about a cam shaft 119 by a frame side plate 117 of a paper feeder 116.

The cam shaft 119 is provided with a torsion spring 120 to energize the cam lever 118 to rotate it clockwise.

Reference numeral 121 is a driven gear which is engaged with a drive gear 122 of a printer body (not shown), and 123 a second gear of the gear train engaged with the driven gear 121 and disposed on the paper feeder 116 side.

A supporting shaft 124 carrying a second gear 123 of the gear train is disposed on the frame side plate 117, and a support plate 125 is freely rotatably carried by the supporting shaft 124. The driven gear 121 is supported by the gear shaft 125A disposed at the bottom of the support plate 125. Therefore, the driven gear 121 is designed to swing about the supporting shaft 124 via the support plate 125.

The top of the support plate 125 and the cam lever 118 are connected via a support plate torsion bar 126. This support plate torsion bar 126 has a less elastic force than the torsion spring 120. In the drawings, 127 is a front cover to rotate the cam lever 118.

FIG. 19 shows a state wherein the driven gear 121 is kept separated away from the drive gear 122. In this state, the printer feeder 116 is placed in position on the printer body and the front cover 127 is closed to force the cam lever 118 rotate counterclockwise, and the support plate torsion bar 126 moves over the dead point to rotate the support plate 12 clockwise, thereby engaging the drive gear 122 with the driven gear 121. This latter state is shown in FIG. 20.

On the other hand, when the front cover 127 is removed from the state shown in FIG. 20, since the torsion spring 120 has a higher elastic force than the support plate torsion bar 126, the cam lever 118 rotates clockwise, and the support plate 125, upon exceeding the dead point of the torsion spring 126, rotates counterclockwise into a state as shown in FIG. 19.

What is claimed is:

1. A printer comprising a printer body having a side and a drive gear thereon, a paper feeder having a side and a driven gear thereon, the paper feeder being freely detachably placed on the printer body, the rotation of the drive gear on the printer body side being transmitted to the driven gear as a rotating power source on the paper feeder side, a driven gear holding mechanism, a driven gear release mechanism and a driven gear engaging mechanism, wherein a gear shaft of the driven gear on the paper feeder side is freely movably provided on the paper feeder so that the driven gear is detachably engaged with the drive gear on the printer body side.

2. A printer comprising a printer body, having a side and a first drive gear thereon, a paper feeder having a side and a driven gear thereon, the driven gear having a shaft, the paper feeder being freely detachably placed on the printer body in which the rotation of the first drive gear on the printer body side is transmitted to the driven gear as a rotating power source on the paper feeder side, the printer body having a second drive gear supported by a shaft, the paper feeder further having a frame including a side plate, wherein the supporting shaft of the second drive gear in engagement with the driven gear is supported by the frame side plate of the feeder, and the gear shaft of the driven gear is disposed to freely swing with respect to the supporting shaft of the second drive gear, so as to detachably engage the driven gear with the first drive gear on the printer body side.

3. A printer comprising a printer body having a side and a first drive gear thereon, a paper feeder having a side and a pair of driven gears thereon, each driven gear of the pair having a shaft, the paper feeder being freely detachably placed on the printer body in which the rotation of the first drive gear on the printer body side is transmitted to the pair of driven gears as a rotating power source on the paper feeder side, the printer body having a second drive gear supported by a shaft, the paper feeder further having a frame side pate, wherein the supporting shaft of the second drive gear in engagement with the pair of driven gears is supported by the frame side plate of the paper feeder, and the gear shaft of each of the pair of driven gears is disposed to freely swing with respect to the supporting shaft of the second drive gear so that each of the pair of driven gears is detachably engaged with the first drive gear on the printer body side.

4. A printer according to claim 3, wherein the driven gears of the pair of driven gears are disposed to face each other edgewise with respect to a vertical line connecting the axes of the supporting shaft of the first drive gear and the supporting shaft of the second drive gear.

5. A printer comprising a printer body having a side and a drive gear thereon, a paper feeder having a side and a driven gear thereon, the paper feeder positioned freely detachably on the printer body, wherein rotation of the drive gear is transmitted to the driven gear as a rotation power source on the paper feeder side, and characterized by providing the paper feeder with a driven gear holding mechanism to separate the driven gear of the paper feeder from the drive gear of the printer and to hold that state, a driven gear release mechanism to release the separated state of the driven gear from the drive gear after the paper feeder is on the printer body, and a driven gear engaging mechanism to engage the driven gear with the drive gear after the above separated state has been released by the driven gear release mechanism.

6. A printer according to claim 5, wherein the paper feeder further comprises a front cover, wherein opening the front cover of the paper feeder activates the gear holding mechanism which separates the driven gear of the paper feeder from the drive gear of the printer and keeps that state, and closing the front cover releases the separated state of the driven and drive gears.

7. A printer according to claim 5, wherein removal of the paper feeder from the printer body removes the weight of the paper feeder itself and activates release of the gear holding mechanism so as to keep the driven gear separated from the printer drive gear, and placing the paper feeder on the printer body so as to position the drive gear with the driven gear upon release of the separated state by the weight of the paper feeder itself.

8. A printer according to claim 5, wherein the paper feeder further comprises a frame including a side plate, the side plate having a hook attached thereon and a lever disposed freely manually rotatably on the side plate wherein the lever is stopped by the hook to activate the gear holding mechanism which separates and keeps the driven gear separated away from the printer drive gear, and the lever is released from the hook to release the separated state.

9. A printer according to claim 5, and further comprising an operating member which when the paper feeder is placed on the printer body displaces with acceptance of the dead weight of the paper feeder, causing operation of a gear releasing mechanism which releases the state of holding the clearance between the printer drive gear and the paper feeder driven gear, such that the operating member which is displaced by receiving the dead weight of the paper feeder to engage the gears, wherein clearance between the drive gear and the driven gear is effected by removing the dead weight of the paper feeder from the operating member by removal of the paper feeder from the printer and operating the gear holding mechanism following recovery from the displacement of the operating member.

* * * * *